US006684842B1

(12) United States Patent
Hellie et al.

(10) Patent No.: US 6,684,842 B1
(45) Date of Patent: Feb. 3, 2004

(54) MULTI-CHAMBER RESONATOR

(75) Inventors: Mark D. Hellie, Westland, MI (US); John D. Kostun, Brighton, MI (US); Michael J. Mungle, Belleville, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 3 days.

(21) Appl. No.: 10/194,690

(22) Filed: Jul. 12, 2002

(51) Int. Cl.[7] ..... F02M 35/10
(52) U.S. Cl. ..... 123/184.57; 181/229
(58) Field of Search ..... 123/184.57; 181/229

(56) References Cited

U.S. PATENT DOCUMENTS

| | | | | |
|---|---|---|---|---|
| 2,271,055 A | | 1/1942 | Wilson | |
| 3,990,415 A | | 11/1976 | Malphettes | |
| 4,164,266 A | * | 8/1979 | Collin et al. | 181/250 |
| 4,765,286 A | | 8/1988 | Lyjak et al. | |
| 5,572,966 A | | 11/1996 | Doddy et al. | |
| 5,602,368 A | * | 2/1997 | Kaneso | 181/255 |
| 5,771,851 A | | 6/1998 | McLean | |
| 5,806,480 A | | 9/1998 | Maeda et al. | |
| 5,839,405 A | | 11/1998 | Falkowski et al. | |
| 5,900,595 A | * | 5/1999 | Akima et al. | 181/229 |
| 5,979,598 A | | 11/1999 | Wolf et al. | |
| 6,178,940 B1 | | 1/2001 | Gossling et al. | |
| 6,199,657 B1 | * | 3/2001 | Misawa et al. | 181/229 |
| 6,205,968 B1 | * | 3/2001 | Spannbauer | 123/184.57 |
| 6,347,609 B1 | | 2/2002 | Bloomer | |

FOREIGN PATENT DOCUMENTS

| | | | |
|---|---|---|---|
| JP | 3-107522 | * | 5/1991 |

* cited by examiner

*Primary Examiner*—Noah P. Kamen
(74) *Attorney, Agent, or Firm*—MacMillan, Sobanski & Todd

(57) ABSTRACT

A multi-chamber resonator box for a vehicle air intake system, wherein the resonator includes a Helmholtz, an expansion chamber, an annular, and a perforated style resonator to militate against the emission of noise energy caused by intake air.

13 Claims, 2 Drawing Sheets

MULTI-CHAMBER RESONATOR

FIELD OF THE INVENTION

The invention relates to a resonator and more particularly to a multi-chamber resonator box for a vehicle air intake system, the resonator including serially arranged Helmholtz, expansion chamber, annular, and perforated type resonators.

BACKGROUND OF THE INVENTION

In an internal combustion engine for a vehicle, it is desirable to design an air induction system in which sound energy generation is minimized. Sound energy is generated as fresh air is drawn into the engine. Vibration is caused by the intake air in the air feed line which creates undesirable intake noise. Resonators of various types such as a Helmholtz type, for example, have been employed to reduce engine intake noise. Such resonators typically include a single chamber for dissipating the intake noise.

It would be desirable to produce a multi-chamber air resonator system which militates against the emission of sound energy caused by the intake air and minimizes underhood space requirements while maintaining desired underhood appearance.

SUMMARY OF THE INVENTION

Consistent and consonant with the present invention, a multi-chamber air resonator system, which militates against the emission of sound energy caused by the intake air and minimizes underhood space requirements while maintaining desired underhood appearance, has surprisingly been discovered.

The multi-chamber resonator system comprises:

a duct having an inlet and an outlet;

a main body surrounding at least a portion of the duct;

at least two resonators of a different type disposed in the main body, the at least two resonators in communication with the duct to attenuate noise travelling through the duct.

BRIEF DESCRIPTION OF THE DRAWINGS

The above, as well as other objects, features, and advantages of the present invention will be understood from the detailed description of the preferred embodiments of the present invention with reference to the accompanying drawings, in which.

DETAILED DESCRIPTION OF THE PREFERRED EMBODIMENTS

Figure 1:
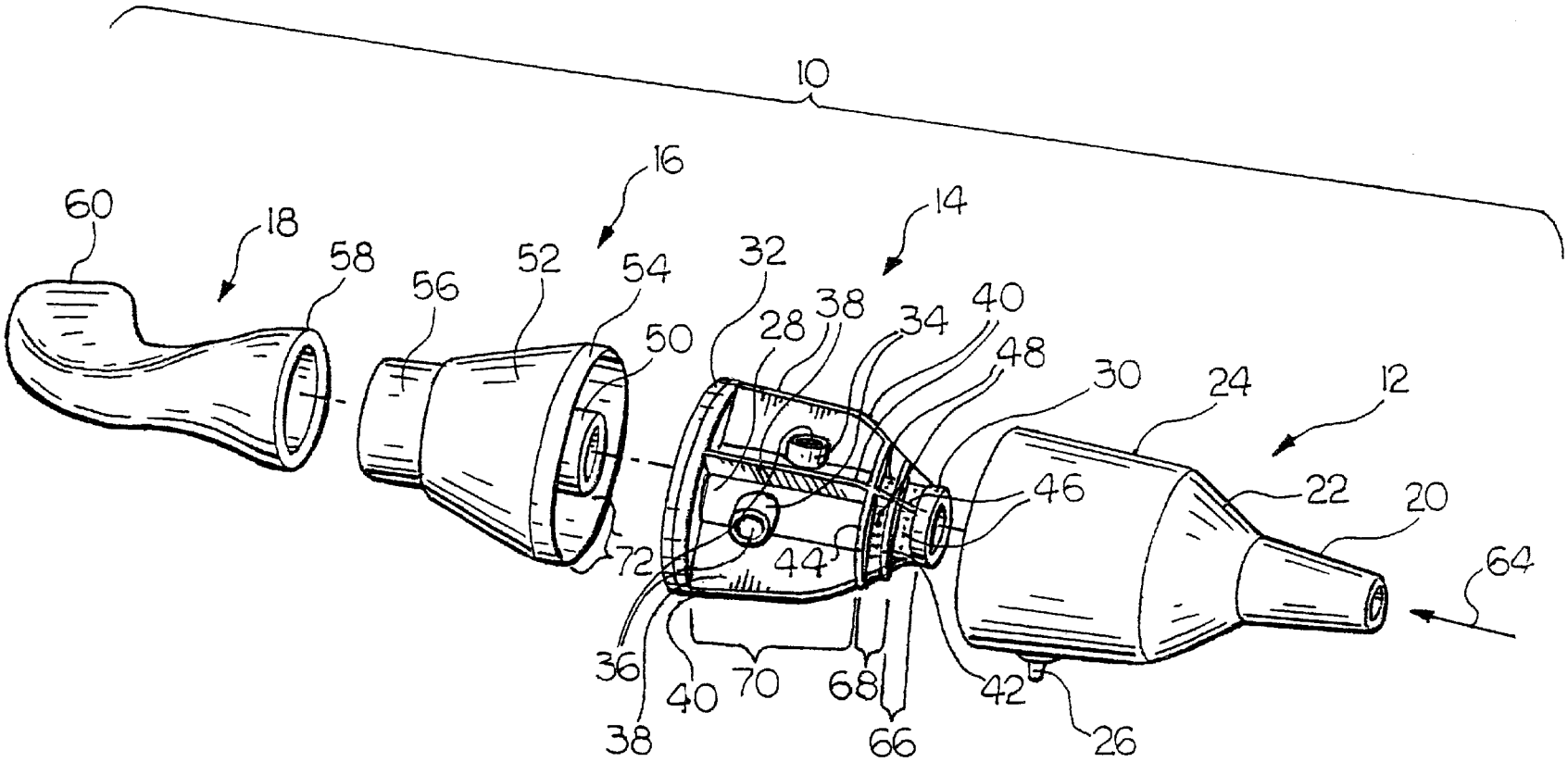
FIG. 1 is an exploded perspective view of a multi-chamber resonator incorporating the features of the present invention.

Referring now to the drawings, and particularly FIG. 1, there is shown generally at 10 a multi-chamber air resonator system incorporating the features of the invention. The air resonator system 10 includes a tray section 12, an inner cover section 14, a cover section 16, and an outlet section 18.

The tray section 12 is hollow and generally bell shaped with two open ends. In the embodiment shown, the tray section 12 is formed to include a smaller diameter air inlet 20, an expanding section 22, and a larger diameter main body 24. The air inlet 20 is adapted to draw air from the atmosphere. The expanding section 22 connects the air inlet 20 and the main body 24. A mounting lug 26 is disposed on the outer wall of the main body 24 for mounting the resonator system 10 as desired.

The inner cover section 14 is adapted to be inserted into the tray section 12. In the embodiment shown, two types of resonators are included in the inner cover section 14. A generally cylindrical hollow center tube 28 extends the length of the inner cover section 14. A nose portion 30 of the tube 28 is adapted to be received in the air inlet 20 of the tray section 12. An airtight fit is desired between the nose portion 30 of the tube 28 and the air inlet 20, but is not critical to the operation of the resonator system 10.

A radially outwardly extending annular plate 32 is disposed on the end of the tube 28 opposite the nose portion 30. An array of radially outwardly extending hollow cylindrical extensions 34 are disposed on an outer wall of the tube 28. In the embodiment shown, four extensions 34 are used. Additional or fewer extensions 34 can be used as desired. An array of apertures 36 are formed in the wall of the tube 28 and are aligned with the hollow interior of the extensions 34.

A plurality of dividing walls 38 are disposed to separate each of the extensions 34 from one another and form a resonator chamber. Each chamber has one of the extensions 34 disposed therein. The walls 38 extend in a longitudinal direction with respect to the tube 28. In the embodiment shown, the quantity of the walls 38 is equal to the quantity of the extensions 34. Each of the walls 38 abut the plate 32. An outer edge 40 of the walls 38 has a shape matching that of the inner surface of the main body 24 and the expanding section 22. The walls 38 terminate adjacent the nose portion 30 of the tube 28 so as not to interfere with the insertion of the nose portion 30 into the air inlet 20. The extensions 34, the apertures 36, and the walls 38 are arranged and sized as needed to form and tune each of the corresponding resonator chambers to the desired frequency for noise attenuation and/or improved sound quality.

A first annular ring 42 and a second annular ring 44 are disposed on the end of the tube 28 adjacent the nose portion 30. The rings 42, 44 cooperate with the walls 38 to form small chambers therebetween. A first annular array of perforations 46 is formed in the outer wall of the tube 28 between the nose portion 30 and the first ring 42. A second annular array of perforations 48 is formed in the outer wall of the tube 28 between the first ring 42 and the second ring 44. In the embodiment shown, two rings 42, 44 and two arrays of perforations 46, 48 are shown. It is understood that more or fewer rings and arrays of perforations could be used without departing from the scope and spirit of the invention.

The cover section 16 includes a generally cylindrical hollow center tube 50. A bell section 52 is formed around the tube 50. The bell 52 has an annular lip 54 which is adapted to be joined with the end of the main body 24 of the tray section 12. One end of the tube 50 of the cover section 16 is adapted to abut the end of the tube 28 of the inner cover section 14. Although an air tight fit is desired between the tube 50 of the cover section 16 and the tube 28 of the inner cover section 14, it is not critical to the operation of the resonator system 10. An outlet tube 56 is formed at the end of the cover section 16 opposite the end of the tube 50 of the cover section 16 which abuts the tube 28 of the inner cover section 14. The tube 50 and the bell 52 of the cover section 16 cooperate to form a resonator volume, which in the embodiment shown has an annular entry for the noise.

Figure 2:
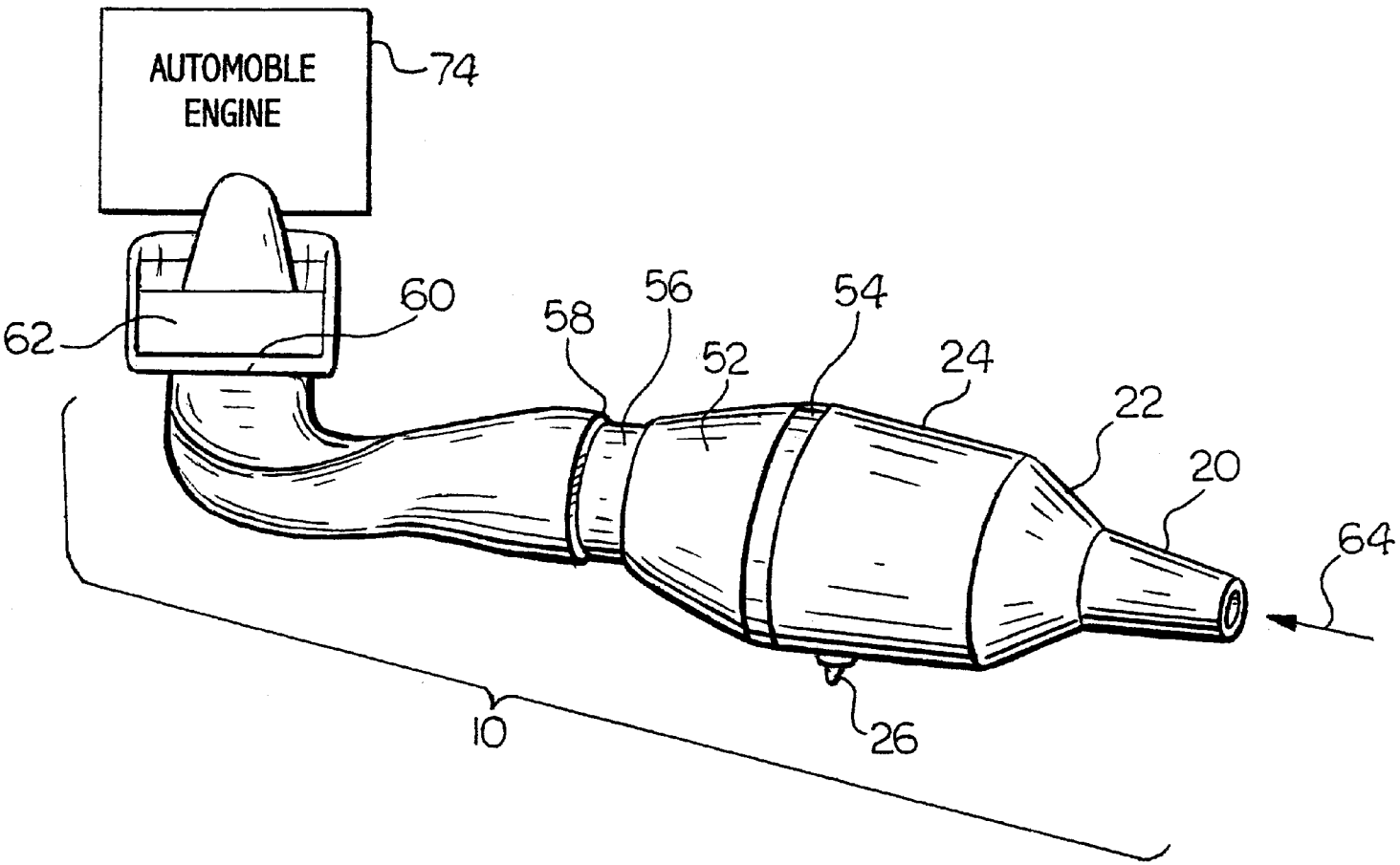
FIG. 2 is a schematic perspective view of the multi-chamber resonator illustrated in FIG. 1 in an assembled state and including an automobile engine air cleaner attached thereto.

The outlet section 18 is a hollow conduit having an inlet end 58 and an outlet end 60. The inlet end 58 is adapted to receive the outlet tube 56 of the cover section 16. Although an air tight fit is desired between the inlet end 58 of the outlet section 18 and the outlet tube 56 of the cover section 16, it is not critical to the operation of the resonator system 10. The outlet end 60 is adapted to be connected to an engine mounted air cleaner 62, as illustrated in FIG. 2. FIG. 2 shows the resonator system 10 in an assembled condition.

In its assembled condition, the air inlet 20, the tube 28, the tube 50, and the outlet section 18 cooperate to form a conduit for air to travel through. Additionally, upon assembly, a series of resonators are formed within the resonator system 10.

In the embodiment shown, the first annular ring 42 cooperates with the inner surface of the expanding section 22, and the outer wall of the tube 28 to form a first chamber therebetween. The first chamber communicates with the hollow portion of the tube 28 through the first perforations 46, thereby forming a first high frequency resonator section 66. Similarly, the second annular ring 44 cooperates with the first annular ring 42, the expanding section 22, and the outer wall of the tube 28 to form a second chamber therebetween. The second chamber communicates with the hollow portion of the tube 28 through the second perforations 48, thereby forming a second high frequency resonator section 68. Although two high frequency resonator sections are illustrated, fewer or more high frequency resonator sections may be used without departing from the scope and spirit of the invention.

Four Helmholtz type resonators are formed in the embodiment shown in the drawings. The plate 32 cooperates with two of the walls 38, the inner surface of the main body 24 of the tray section 12, and the outer wall of the tube 28 to form a first Helmholtz resonator chamber. The first Helmholtz resonator chamber communicates with the hollow portion of the tube 28 through one of the apertures 36, thereby forming a Helmholtz resonator. Three other Helmholtz resonators are similarly formed and cooperate to form a Helmholtz resonator section 70. Fewer or more Helmholtz resonator sections may be used without departing from the scope and spirit of the invention.

An annular entry type resonator 72 is formed in the cover section 16 for attenuating low frequency noise. The tube 50 extends from the tube 28 and a desired distance into the tube 56. A clearance exists between the outer wall of the tube 50 and the inner wall of the tube 56. The annular entry into the chamber of the annular resonator 72 is formed by the clearance between the outer wall of the tube 50 and the inner wall of the tube 56. The noise enters the chamber of the annular resonator 72 through the clearance.

It is understood that other resonator types could be used such as an expansion chamber type, for example, in place of the above resonator types without departing from the scope and spirit of the invention.

In operation, air enters the resonator system 10 through the air inlet 20, as indicated by the arrow 64. The air travels through the conduit formed by the air inlet 20, the tube 28, the tube 50, and the outlet section 18, through the air cleaner 62, and into an associated engine 74. Noise generated by the engine 74 travels outward through the air cleaner 62, the outlet section 18, the tube 50, the tube 28, and exits through the tube 20 in a direction opposite to the air flow. The first high frequency resonator section 66, the second high frequency resonator section 68, the Helmholtz resonator section 70, and the annular resonator 72 receive the noise pulses at various frequencies and reduce the amplitude of the noise pulses. By reducing the amplitude of the noise pulses, a desired sound quality is reached.

Since each resonator section has a separate chamber volume, individual noise pulse frequencies can be attenuated. Adjustments to or tuning of the individual resonator sections can be made by adjusting the volume of the chambers, the inside diameter of the apertures 36 or perforations 46, 48, or the length of the extensions 34. Tuning can also be accomplished by modifying the conduit formed by the tube 28, the tube 50, and the outlet 18. The location of the walls 38 and the annular rings 42, 44 can be altered to change the volume of the chambers of the Helmholtz resonators and the high frequency resonators, respectively. By using the multi-chamber design with the different types of resonators, complex tuning can be accomplished to reach desired sound quality. Additionally, the multi-chamber design facilitates an efficient use of space under the hood of an automobile.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A multi-chamber air resonator comprising:

a duct having an inlet and an outlet;

a main body surrounding at least a portion of said duct;

an expansion chamber type resonator, an annular type resonator, a Helmholtz type resonator, and a perforated type resonator disposed in said main body, said resonators in communication with said duct to attenuate noise travelling through said duct.

2. The multi-chamber air resonator according to claim 1, wherein said resonators are arranged in series.

3. The multi-chamber air resonator according to claim 1, wherein at least one of said resonators are tunable.

4. A multi-chamber air resonator comprising:

a hollow tray section having an air inlet;

an inner cover section adapted to be inserted into said tray section, said inner cover including a hollow tube having an inlet and an outlet, the inlet of the tube of the inner cover section adapted to be in fluid communication with the air inlet of said tray section, said inner cover section including at least one of a Helmholtz type resonator and a perforated type resonator in communication with the hollow portion of the tube of said inner cover section; and a cover section including a hollow tube having an inlet and an outlet, the inlet of the tube of said cover section adapted to be in fluid communication with the outlet of the tube of said inner cover section, said cover section including an annular type resonator therein for attenuating low frequency noise travelling in the tube of said cover section.

5. The multi-chamber air resonator according to claim 4, wherein the resonator included in said inner cover is a Helmholtz type resonator, the Helmholtz type resonator including a plurality of walls extending longitudinally along an outer wall of the tube of said inner cover, the walls adapted to cooperate with an inner surface of said tray section and the plate of said inner cover to form a plurality of chambers therebetween, the tube of said inner cover having a plurality of apertures formed therein, each of the apertures having a hollow extension projecting radially outwardly therefrom to facilitate fluid communication between each of the plurality of chambers and the hollow portion of the tube of said inner cover section.

6. The multi-chamber air resonator according to claim 4, wherein the resonator included in said inner cover is a perforated type resonator, the perforated type resonator including at least one annular ring extending radially from an outer wall of the tube of said inner cover, the annular ring adapted to cooperate with an inner surface of said tray section to form a perforated type resonator chamber, the tube of said inner cover having a plurality of perforations to facilitate fluid communication between the perforated type resonator chamber and the hollow portion of the tube of said inner cover section.

7. The multi-chamber air resonator according to claim 4, wherein the inlet of the tube of the inner cover section is adapted to be inserted in the air inlet of said tray section to form an airtight connection.

8. The multi-chamber air resonator according to claim 4, wherein the inlet of the tube of said cover section is adapted to abut the outlet of the tube of said inner cover section to form an airtight connection.

9. An air intake system for a vehicle comprising:

a vehicle engine having an air intake port communicating with a source of air;

an air resonator disposed in the air intake port, said air resonator comprising:

a hollow tray section having an air inlet;

an inner cover section adapted to be inserted into said tray section, said inner cover including a hollow tube having an inlet and an outlet, the inlet of the tube of the inner cover section adapted to be in fluid communication with the air inlet of said tray section, said inner cover section including at least one of a Helmholtz type resonator and a perforated type resonator in communication with the hollow portion of the tube of said inner cover section; and a cover section including a hollow tube having an inlet and an outlet, the inlet of the tube of said cover section adapted to be in fluid communication with the outlet of the tube of said inner cover section.

10. The air intake system according to claim 9, wherein the resonator included in said inner cover is a Helmholtz type resonator, the Helmholtz type resonator including a plurality of walls extending longitudinally along an outer wall of the tube of said inner cover, the walls adapted to cooperate with an inner surface of said tray section and the plate of said inner cover to form a plurality of Helmholtz type resonator chambers therebetween, the tube of said inner cover having a plurality of apertures formed therein, each of the apertures having a hollow extension projecting radially outwardly therefrom to facilitate fluid communication between each of the plurality of Helmholtz type resonator chambers and the hollow portion of the tube of said inner cover section.

11. The air intake system according to claim 9, wherein the resonator included in said inner cover is a perforated type resonator, the perforated type resonator including at least one annular ring extending radially from an outer wall of the tube of said inner cover, the annular ring adapted to cooperate with an inner surface of said tray section to form a perforated type resonator chamber, the tube of said inner cover having a plurality of perforations to facilitate fluid communication between the perforated type resonator chamber and the hollow portion of the tube of said inner cover section.

12. The air intake system according to claim 9, wherein the inlet of the tube of the inner cover section is adapted to be inserted in the air inlet of said tray section to form an airtight connection.

13. The air intake system according to claim 9, wherein the inlet of the tube of said cover section is adapted to abut the outlet of the tube of said inner cover section to form an airtight connection.

* * * * *